US011612299B2

(12) United States Patent
Haegermarck

(10) Patent No.: US 11,612,299 B2
(45) Date of Patent: Mar. 28, 2023

(54) WASH ARM ASSEMBLY

(71) Applicant: ELECTROLUX APPLIANCES AKTIEBOLAG, Stockholm (SE)

(72) Inventor: Anders Haegermarck, Trångsund (SE)

(73) Assignee: Electrolux Appliances Aktiebolag

( * ) Notice: Subject to any disclaimer, the term of this patent is extended or adjusted under 35 U.S.C. 154(b) by 329 days.

(21) Appl. No.: 16/759,894

(22) PCT Filed: Oct. 31, 2017

(86) PCT No.: PCT/EP2017/077875
§ 371 (c)(1),
(2) Date: Apr. 28, 2020

(87) PCT Pub. No.: WO2019/086107
PCT Pub. Date: May 9, 2019

(65) Prior Publication Data

US 2020/0329944 A1 Oct. 22, 2020

(51) Int. Cl.
*A47L 15/23* (2006.01)
*A47L 15/42* (2006.01)

(52) U.S. Cl.
CPC ..... *A47L 15/23* (2013.01); *A47L 15/4278* (2013.01); *A47L 2501/20* (2013.01)

(58) Field of Classification Search
CPC ... A47L 15/23; A47L 15/4278; A47L 2501/20
See application file for complete search history.

(56) References Cited

U.S. PATENT DOCUMENTS

| | | | |
|---|---|---|---|
| 1,408,077 | A | 2/1922 | Clinton |
| 2,013,387 | A | 9/1935 | Johnston |
| 2,637,595 | A | 5/1953 | Fox et al. |
| 3,267,944 | A | 8/1966 | Meeker et al. |
| 3,342,421 | A | 9/1967 | Schutte |
| 3,362,645 | A | 1/1968 | Clark |

(Continued)

FOREIGN PATENT DOCUMENTS

| | | | |
|---|---|---|---|
| AT | 251239 | B | 12/1966 |
| CH | 406549 | A | 1/1966 |

(Continued)

OTHER PUBLICATIONS

International Search Report and Written Opinion for Application No. PCT/EP2017/077875 dated Jan. 11, 2018, 10 pages.

*Primary Examiner* — Michael E Barr
*Assistant Examiner* — Pallavi Chitta
(74) *Attorney, Agent, or Firm* — RatnerPrestia

(57) ABSTRACT

Provided herein is a wash arm assembly for a dishwasher, and a corresponding dishwasher including the same. The wash arm assembly may include a wash arm, comprising a tubular connection portion and at least one nozzle, and a tubular receiving portion for receiving the tubular connection portion. The tubular connection portion may be arranged to be inserted in the tubular receiving portion to create a seal between the tubular connection portion and the tubular receiving portion. The seal may allow the wash arm to rotate, and the tubular receiving portion and the tubular connection portion may be arranged to allow a washing liquid of the dishwasher to travel in a first direction to the wash arm.

15 Claims, 3 Drawing Sheets

(56) References Cited

U.S. PATENT DOCUMENTS

| | | | |
|---|---|---|---|
| 3,468,485 | A | 9/1969 | Sully |
| 3,677,473 | A | 7/1972 | Belaieff |
| 3,771,725 | A | 11/1973 | Jenkins et al. |
| 3,918,644 | A | 11/1975 | Platt et al. |
| 4,064,887 | A | 12/1977 | Geiger et al. |
| 4,210,285 | A | 7/1980 | Dicken et al. |
| 4,266,565 | A | 5/1981 | Gurubatham |
| 4,301,822 | A | 11/1981 | Dingler |
| 4,869,428 | A | 9/1989 | Gombar |
| 5,211,190 | A | 5/1993 | Johnson et al. |
| 5,268,153 | A | 12/1993 | Muller |
| 5,433,228 | A | 7/1995 | Dingler |
| 5,477,874 | A | 12/1995 | Yura et al. |
| 5,542,443 | A | 8/1996 | Yura et al. |
| 5,598,976 | A | 2/1997 | Jang et al. |
| 5,609,174 | A | 3/1997 | Ferguson |
| 5,623,956 | A | 4/1997 | Kirkland |
| 5,662,744 | A | 9/1997 | Tuller et al. |
| 5,673,716 | A | 10/1997 | Gurubatham et al. |
| 5,752,533 | A | 5/1998 | Edwards |
| 5,904,166 | A | 5/1999 | Nannt et al. |
| 6,357,460 | B1 | 3/2002 | Bertsch et al. |
| D461,284 | S | 8/2002 | Hegeman et al. |
| 6,662,814 | B2 | 12/2003 | Tobbe et al. |
| 6,959,881 | B2 | 11/2005 | Kim |
| 7,237,563 | B2 | 7/2007 | Han et al. |
| 7,753,062 | B2 | 7/2010 | Burrows et al. |
| 7,931,034 | B2 | 4/2011 | Mack et al. |
| 7,988,791 | B2 | 8/2011 | Delgado |
| 8,020,468 | B2 | 9/2011 | Yang |
| 8,020,568 | B2 | 9/2011 | Pyo |
| 8,211,243 | B2 | 7/2012 | Delgado |
| 8,287,660 | B2 | 10/2012 | Chen et al. |
| 8,333,207 | B2 | 12/2012 | Calhoun et al. |
| D675,387 | S | 1/2013 | Burrows et al. |
| 8,807,150 | B2 | 8/2014 | Boyer et al. |
| 8,858,729 | B2 | 10/2014 | Buddharaju et al. |
| 8,939,162 | B2 | 1/2015 | Winkler et al. |
| 8,985,126 | B2 | 3/2015 | Forster et al. |
| 9,010,345 | B2 | 4/2015 | Mitchell et al. |
| 9,314,144 | B2 | 4/2016 | Bayer et al. |
| 9,427,132 | B2 | 8/2016 | Boyer et al. |
| 9,456,730 | B2 | 10/2016 | Bayer et al. |
| 9,462,924 | B2 | 10/2016 | Pyo et al. |
| 9,462,925 | B2 | 10/2016 | Boyer et al. |
| 9,462,927 | B2 | 10/2016 | Lee et al. |
| 9,516,988 | B2 | 12/2016 | Zhao et al. |
| 10,582,827 | B2 | 3/2020 | Yoo et al. |
| 10,682,037 | B2 | 6/2020 | Feddema et al. |
| 10,743,740 | B2 | 8/2020 | Feddema et al. |
| 10,952,589 | B2 | 3/2021 | Brightbill et al. |
| 10,959,596 | B2 | 3/2021 | Feddema et al. |
| 11,219,349 | B2 | 1/2022 | Haegermarck |
| 2005/0045672 | A1 | 3/2005 | Marone |
| 2005/0224098 | A1 | 10/2005 | Fujii et al. |
| 2005/0230502 | A1 | 10/2005 | Bragg et al. |
| 2005/0241681 | A1 | 11/2005 | Hwang |
| 2006/0054204 | A1 | 3/2006 | Fischer |
| 2009/0145468 | A1 | 6/2009 | Chericoni |
| 2009/0255560 | A1 | 10/2009 | Lehmann et al. |
| 2010/0012158 | A1 | 1/2010 | Rosenbauer et al. |
| 2010/0065091 | A1 | 3/2010 | Hartmann et al. |
| 2011/0174345 | A1 | 7/2011 | Carrer et al. |
| 2011/0203619 | A1 | 7/2011 | Kara et al. |
| 2012/0037193 | A1 | 2/2012 | Bayer et al. |
| 2012/0279534 | A1 | 11/2012 | Boyer et al. |
| 2012/0279536 | A1 | 11/2012 | Adams et al. |
| 2012/0305037 | A1 | 12/2012 | Petric et al. |
| 2013/0125936 | A1 | 5/2013 | Forster et al. |
| 2013/0206179 | A1 | 8/2013 | Watson et al. |
| 2013/0284216 | A1 | 10/2013 | Forster et al. |
| 2014/0102492 | A1 | 4/2014 | Kim et al. |
| 2014/0190534 | A1 | 7/2014 | Boyer |
| 2014/0345654 | A1 | 11/2014 | Cho et al. |
| 2015/0020855 | A1 | 1/2015 | Lundberg et al. |
| 2016/0015241 | A1 | 1/2016 | Han et al. |
| 2016/0192818 | A1 | 7/2016 | Gursoy et al. |
| 2016/0220090 | A1 | 8/2016 | Woo et al. |
| 2016/0324392 | A1 | 11/2016 | Xu et al. |
| 2016/0324393 | A1 | 11/2016 | Xu et al. |
| 2017/0354308 | A1 | 12/2017 | Choi et al. |
| 2017/0354311 | A1 | 12/2017 | Yoo et al. |
| 2017/0354312 | A1 | 12/2017 | Woo et al. |
| 2018/0271348 | A1 | 9/2018 | Li |
| 2020/0323415 | A1 | 10/2020 | Feddema et al. |

FOREIGN PATENT DOCUMENTS

| | | | | |
|---|---|---|---|---|
| CH | 564937 | A5 | 8/1975 | |
| CN | 201312795 | Y | 9/2009 | |
| CN | 201333016 | Y | 10/2009 | |
| CN | 101677743 | A | 3/2010 | |
| CN | 102170816 | A | 8/2011 | |
| CN | 102469907 | A | 5/2012 | |
| CN | 102905602 | A | 1/2013 | |
| CN | 203789866 | U | 8/2014 | |
| CN | 104271024 | A | 1/2015 | |
| CN | 104284620 | A | 1/2015 | |
| CN | 205268092 | U | 6/2016 | |
| DE | 7122831 | U | 9/1971 | |
| DE | 3428439 | A1 | 2/1986 | |
| DE | 8516941 | U1 | 10/1986 | |
| DE | 3702828 | C1 | 4/1988 | |
| DE | 4004319 | A1 | 8/1991 | |
| DE | 9114093 | U1 | 3/1993 | |
| DE | 9211182 | U1 | 12/1993 | |
| DE | 19736919 | A1 | 3/1999 | |
| DE | 19812329 | C1 | 6/1999 | |
| DE | 19841355 | A1 | 3/2000 | |
| DE | 20014038 | U1 | 12/2000 | |
| DE | 29921565 | U1 | 4/2001 | |
| DE | 20113227 | U1 | 10/2001 | |
| DE | 102010043021 | A1 | 5/2012 | |
| DE | 102011088494 | A1 | 6/2013 | |
| DE | 10 2015 207588 | A1 | 10/2016 | |
| EP | 0 335 791 | A1 | 10/1989 | |
| EP | 0389852 | A2 | 10/1990 | |
| EP | 0 772 994 | A1 | 5/1997 | |
| EP | 1238622 | A2 | 9/2002 | |
| EP | 1767134 | A2 | 3/2007 | |
| EP | 2050480 | A1 | 4/2009 | |
| EP | 2067428 | A2 | 6/2009 | |
| EP | 2192852 | A1 | 6/2010 | |
| EP | 2215952 | A1 | 8/2010 | |
| EP | 2240065 | A1 | 10/2010 | |
| EP | 2389851 | A1 | 11/2011 | |
| EP | 2441369 | A2 | 4/2012 | |
| EP | 2446799 | A2 | 5/2012 | |
| EP | 2494906 | A1 | 9/2012 | |
| EP | 2556781 | A1 | 2/2013 | |
| EP | 2 721 989 | A1 | 4/2014 | |
| EP | 2721989 | A1 * | 4/2014 | ..... A47L 15/23 |
| EP | 3 050 480 | A1 | 8/2016 | |
| EP | 3085293 | A1 | 10/2016 | |
| GB | 1 462 398 | A | 1/1977 | |
| GB | 1462398 | A * | 1/1977 | ..... A47L 15/23 |
| IT | TO20030117 | U1 | 1/2005 | |
| JP | 50140271 | U | 11/1975 | |
| JP | 04338438 | A | 11/1992 | |
| JP | 07163505 | A | 6/1995 | |
| JP | 07250799 | A | 10/1995 | |
| JP | 1057295 | A | 3/1998 | |
| JP | 10127560 | A | 5/1998 | |
| JP | 2861792 | B2 | 2/1999 | |
| JP | 2006 095001 | A | 4/2006 | |
| JP | 2011224232 | A | 11/2011 | |
| JP | 2014 004270 | A | 1/2014 | |
| KR | 100457573 | B1 | 11/2004 | |
| KR | 101054221 | B1 | 8/2011 | |
| KR | 20120022429 | A | 3/2012 | |
| KR | 20120078276 | A | 7/2012 | |
| KR | 101598753 | B1 | 2/2016 | |
| WO | 2006069827 | A1 | 7/2006 | |
| WO | 2009021626 | A1 | 2/2009 | |

(56) References Cited

FOREIGN PATENT DOCUMENTS

| | | | |
|---|---|---|---|
| WO | 2009083576 | A1 | 7/2009 |
| WO | 2010089149 | A2 | 8/2010 |
| WO | 2011038189 | A1 | 3/2011 |
| WO | WO 2011/147716 | A1 | 12/2011 |
| WO | 2015144198 | A1 | 10/2015 |
| WO | 2015149859 | A1 | 10/2015 |
| WO | 2018006976 | A1 | 1/2018 |
| WO | WO 2018/006975 | A1 | 1/2018 |
| WO | 2019086107 | A1 | 5/2019 |

* cited by examiner

WASH ARM ASSEMBLY

CROSS-REFERENCE TO RELATED APPLICATIONS

This application is a national stage application filed under 35 U.S.C. § 371 of International Application No. PCT/EP2017/077875 filed Oct. 31, 2017, which application is hereby incorporated by reference in its entirety.

TECHNICAL FIELD

Embodiments herein relate to a wash arm assembly for a dishwasher.

BACKGROUND

Today's dishwashers are expected to perform high quality washing of dishware while at the same time to efficiently use water and energy in order to fulfill requirements concerning environmental impact and sustainability. Consumers expect these dishwashers to perform at peak efficiency for substantial lifespans without performance degradation. Various arrangements, taking up some space within the dishwasher, for washing of the dishware in an efficient manner have thus been developed. However, it is also desired that the dishwashers can accommodate a lot of dishware to be washed. Therefore, it is desired that space within the dishwashers for accommodating dishware is as large as possible. A trade-off between space for dishware and environmental impact is consequently made.

A known dishwasher comprises a so called upper wash arm connection as one typical example of the aforementioned arrangements for washing of dishware. The upper wash arm connection connects an upper central wash arm to a tube for providing washing liquid to be exerted out of the upper central wash arm. It is thus desired that the upper wash arm connection has a low profile to limit space occupied by it within the dishwasher. Furthermore, leakage of the washing liquid through the connection is desired to be limited. The upper wash arm connection should also be characterized by low friction, low sensitive to dirt and high abrasive resistance.

Furthermore, the known dishwasher can comprise a satellite wash arm, connected to the central wash arm by means of a bearing. The bearing includes a tubular connection portion of the satellite wash arm inserted in a tubular receiving portion of the central wash arm. The bearing allows the satellite wash arm to rotate in relation to the central wash arm. During operation of the dishwasher, when the washing liquid is delivered to the satellite wash arm through the central wash arm, the washing liquid causes the satellite wash arm to lift from the bearing. Usually, there is a locking means limiting a distance the satellite wash arm may lift. The lift of the satellite wash arm results in leakage of washing liquid between the tubular connection and tubular receiving portions. The leakage lubricates the bearing, whereby friction between the tubular connection and tubular receiving portions is reduced.

One problem with known wash arm assemblies, such as the wash arm connection, the bearing and the like, is that a wash arm, such as the satellite wash arm or the central wash arm, may wobble when, for example dirt get stuck in the wash arm assembly if the wash arm lifts too much during operation of the dishwasher. Wobbling causes more leakage and larger losses due to increased friction. The wobbling may also cause the wash arm to hit some part of the dishwasher or dishware accommodated in the dishwasher. One solution to this wobbling is a tighter seal, such as by an O-ring or gasket, that prevents fluid from passing through the wash arm connection; however, such a seal does not permit the wash arms to rotate freely and the tighter sealing components tend to wear over time.

BRIEF SUMMARY

An object of the embodiments herein is to provide a wash arm assembly for a dishwasher comprising a wash arm, which the wash arm assembly provides an improved rotational movement of the wash arm while maintaining a sufficient seal to prevent unnecessary fluid loss and inefficiency.

According to an aspect of the present disclosure, the object is achieved by a wash arm assembly for a dishwasher. The wash assembly comprises a wash arm, comprising a tubular connection portion and a tubular receiving portion for receiving the tubular connection portion. The tubular connection portion is arranged to be inserted in the tubular receiving portion to create a connection between the tubular connection portion and the tubular receiving portion. Thus, the tubular connection portion may be easily connected to the tubular receiving portion by inserting the tubular connection portion in the tubular receiving portion. Further, the tubular connection portion and the tubular receiving portion may be easily disconnected by pulling out the tubular connection portion from the tubular receiving portion.

The connection allows the wash arm to rotate, which means that the tubular connection portion of the wash arm may rotate in relation to the tubular receiving portion when the tubular connection portion has been inserted in the tubular receiving portion. Further, the connection is arranged to conduct a washing liquid of the dishwasher in a first direction to the wash arm. Thus, the washing liquid may be supplied to the wash arm through the connection in the first direction.

In one embodiment, a wash arm assembly for a dishwasher may be provided. The wash arm assembly may include a wash arm comprising a tubular connection portion and at least one nozzle, and the wash arm assembly may include a tubular receiving portion for receiving the tubular connection portion. The tubular connection portion may be arranged to be inserted in the tubular receiving portion to create a seal between the tubular connection portion and the tubular receiving portion, wherein the seal may allow the wash arm to rotate, and wherein the tubular receiving portion and the tubular connection portion may be arranged to allow a washing liquid of the dishwasher to travel in a first direction to the wash arm. The tubular receiving portion may define a lip configured to overlap a portion of the tubular connection portion. At least a portion of the lip may be disposed radially inward of the portion of the tubular connection portion. In some embodiments, the tubular connection portion may define a first sealing surface and a second sealing surface. The lip may define a third sealing surface oriented at least partially in a second direction opposite the first direction, and wherein the tubular receiving portion may define a fourth sealing surface oriented in the first direction. The first sealing surface may be aligned to the third sealing surface and the second sealing surface may be aligned to the fourth sealing surface. The first sealing surface, the second sealing surface, the third sealing surface, and the fourth sealing surface may at least partially define the seal.

The tubular receiving portion may at least partially surround an upstream end of the tubular connection portion, and wherein the lip may be disposed radially inward of the upstream end of the tubular connection portion. The first sealing surface may be adjacent to the second sealing surface, and the third sealing surface may be adjacent to the fourth sealing surface.

In some embodiments, the tubular connection portion may further include a fifth sealing surface, and the tubular receiving portion may further include a sixth sealing surface. The fifth sealing surface may be aligned to the sixth sealing surface. The seal may be defined by the first sealing surface, the second sealing surface, the third sealing surface, the fourth sealing surface, the fifth sealing surface, and the sixth sealing surface. The respective pairs of the first sealing surface and the third sealing surface, the second sealing surface and the fourth sealing surface, and the fifth sealing surface and the sixth sealing surface may be arranged sequentially to define the seal. The angles of the first sealing surface and the third sealing surface may be different from the angles of the second sealing surface and the fourth sealing surface. The angles of the second sealing surface and the fourth sealing surface may be different from the angles of the fifth sealing surface and the sixth sealing surface.

The first sealing surface, the second sealing surface, the third sealing surface, and the fourth sealing surface may be shaped as cut-off cones.

In some embodiments, the tubular connection portion and the tubular receiving portion may each be made of a uniform material. In some embodiments, the tubular connection portion and the tubular receiving portion may be in direct contact, and the seal may not include any additional structure between the tubular connection portion and the tubular receiving portion.

In some embodiments, the lip of the tubular receiving portion may define a leading edge terminating at a central bore of the tubular connection portion and the tubular receiving portion.

At least one nozzle of the wash arm may be oriented at least partially in the first direction, such that the strength of the seal increases as the pressure of the fluid exiting the nozzle increases. In some embodiments, the back pressure required to overcome the seal may be greater than the liquid pressure within tubular connection portion or tubular receiving portion of the seal.

The wash arm assembly may further include a main wash arm, wherein the wash arm may be a satellite arm rotatably mounted to the main wash arm at the seal, and wherein the main wash arm may include the tubular receiving portion.

In some embodiments, the tubular connection portion and tubular receiving portion may be configured to allow a small amount of washing liquid therebetween to lubricate the seal. The tubular receiving portion may be connectable to a conduit arranged to convey the washing liquid to an interior of the dishwasher.

In some embodiments, a dishwasher may be provided that includes the wash arm assembly described herein.

In another embodiment, the tubular connection portion may include a first sealing surface and a second sealing surface, and the tubular receiving portion comprises a third sealing surface and a fourth sealing surface, wherein the first sealing surface is aligned to the third sealing surface and the second sealing surface is aligned to the fourth sealing surface when the tubular connection portion is inserted in the tubular receiving portion. As an effect thereof, the tubular insertion portion may be guided into a predetermined position in relation to the tubular receiving portion when the tubular insertion portion is inserted into the tubular receiving portion. In other words, the first, second, third and fourth sealing surfaces may be arranged to lead, or guide, the tubular insertion portion to the predetermined position in relation to the tubular receiving portion when the tubular insertion portion is inserted into the tubular receiving portion. Said predetermined position of the tubular insertion portion in relation to the tubular receiving portion is a position, in which an essentially unhindered, or non-inhibited, rotation of the tubular insertion portion within the tubular receiving portion. In such a position, the first sealing surface and the third sealing surface as well as the second sealing surface and the fourth sealing surface are at least substantially parallel to each other. To sum up, thanks to the first, second, third and fourth sealing surfaces, the tubular insertion portion may easily be positioned in the tubular insertion means in said predetermined position to achieve an improved rotational movement for the wash arm. Further, the predetermined position may be achieved repeatedly each time the tubular insertion portion is inserted in the tubular receiving portion thanks to the sealing surfaces of the tubular insertion portion and the tubular receiving portion.

The first, second, third and fourth sealing surfaces may be arranged to guide the tubular connection portion and the tubular receiving portion into alignment with each other upon rotation of the wash arm. The tubular connection portion may be tapered in the first direction along the first sealing surface, and wherein the tubular connection portion may be tapered in a second direction, being opposite to the first direction, along the second sealing surface. The tubular receiving portion may be tapered in the first direction along the third sealing surface and wherein the tubular receiving portion is tapered in the second direction along the fourth sealing surface.

Since the first, second, third and fourth sealing surfaces may be arranged to guide the tubular connection portion and the tubular receiving portion into alignment with each other upon rotation of the wash arm, the tubular connection portion and the tubular receiving portion may be guided to a position where the first, second, third and fourth sealing surfaces align with each other upon rotation of the wash arm. In such a position the first, second, third and fourth sealing surfaces may be at least substantially parallel with each other. Thereby, during rotation of the wash arm, the first, second, third and fourth sealing surfaces may all be the time guided into alignment with each other even if the first, second, third and fourth sealing surfaces are not pairwise completely parallel to each other at all times as explained in more detail below.

A disturbance of the wash arm, effecting the rotational movement of the wash arm, may lead to wobbling of the wash arm. During the wobbling, the first, second, third and fourth sealing surfaces are displaced from alignment with each other. However, on account of that the tubular connection portion is tapered in the first direction along the first sealing surface and that the tubular receiving portion is tapered in the first direction along the third sealing surface, the tubular connection portion is guided back to the position where the first and third sealing surfaces align with each other. Additionally, on account of that the tubular connection portion may be tapered in a second direction along the second sealing surface and that the tubular receiving portion may be tapered in the second direction along the fourth sealing surface, the tubular connection portion is guided back to the position where the second and fourth sealing surfaces align with each other.

To sum up, when a disturbance of the wash arm occurs the tubular insertion portion is guided back, e.g. brought back, to a position where the first, second, third and fourth sealing surfaces align with each other upon rotation of the wash arm. This occurs thanks to friction forces, acting on the tubular connection portion and creating a momentum that with Coriolis forces strives to straighten the wash arm's position during rotation of the wash arm. The forces and the momentum are created because the tubular connection portion and the tubular receiving portion are tapered along the first, second, third and fourth sealing surfaces as described above. Thereby, wobbling of the wash arm may be prevented and a strong seal maintained without excessive wear.

The wash arm assembly may comprise a main wash arm of the dishwasher, wherein the wash arm is connectable to the main wash arm by means of the connection, wherein the main wash arm comprises the tubular receiving portion. Thereby, the wash arm may be attached to the main wash arm. The wash arm thus acts as a so called satellite wash arm. Accordingly, an improved wash arm assembly for assembling the satellite wash arm onto the main wash arm is achieved.

In some embodiments, the tubular receiving portion is connectable to a conduit arranged to convey the washing liquid to an interior of the dishwasher. Thereby, the wash arm may be attached to a tube for supplying the washing liquid to the dishwasher.

The first sealing surface is defined by a first envelope surface of a first cut-off cone pointing in the first direction.

The second sealing surface is defined by a second envelope surface of a second cut-off cone pointing in the second direction.

According to another aspect of the embodiments herein, the object is achieved by a dishwasher comprising a wash arm assembly according to the embodiments herein.

Further features of, and advantages with, the embodiments herein will become apparent when studying the appended claims and the following detailed description. Those skilled in the art will realize that the different features described may be combined to create embodiments other than those described in the following, without departing from the scope of the embodiments herein, as defined by the appended claims.

BRIEF DESCRIPTION OF THE DRAWINGS

The various aspects of the embodiments herein, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined. Like numbers refer to like elements throughout. Well-known functions or constructions will not necessarily be described in detail for brevity and/or clarity. As used herein, the term "tubular" is not intended to limit the described features to purely cylindrical or tube-shaped elements, and "tubular" components may also have any other shape that accomplishes the structural or functional recitations described herein. For example, a "tubular" component may be partly or wholly conical, or may have additional protrusions, structures, or curvature extending therefrom.

Figure 1:
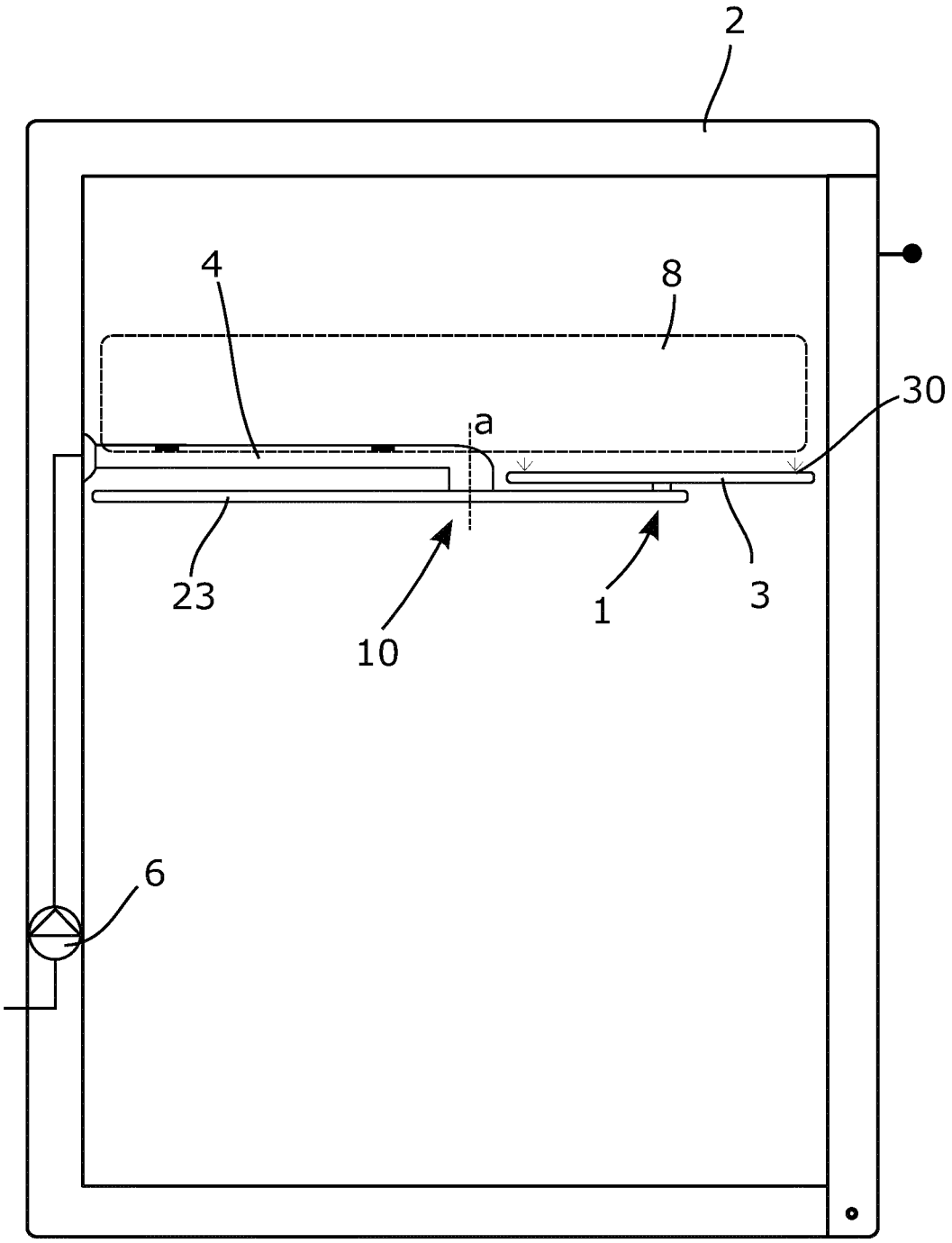
FIG. 1 is a perspective view illustrating a dishwasher comprising a wash arm assembly.

FIG. 1 illustrates a wash arm assembly 1 arranged within an interior of a dishwasher 2. The dishwasher 2 may thus be said to comprise the wash arm assembly 1. The dishwasher 2 comprises a wash arm 3 and main wash arm 23. The wash arm 3 is sometimes referred to as a satellite wash arm in relation to the main wash arm 23. As shown in FIG. 1 the main wash arm 23 is rotatably connected to a main tube 4, through which a washing liquid is supplied to the wash arm assembly 1. The main wash arm 23 is arranged to rotate around an axis a. Typically, the main tube 4 is connected to a washing liquid supply line comprising a pump 6 for supplying of the washing liquid to the dishwasher 2. According to the embodiment illustrated in FIG. 1, the wash arm assembly 1 is arranged under a basket 8 for accommodating dishware (not shown) to be washed within the dishwasher 2. In such a position within the dishwasher 2, the wash arm assembly 1 may also be referred to as an upper wash arm assembly. It means that the wash arm assembly is arranged at an upper position within the interior of the dishwasher 2. The upper position shall be understood as "upper" in relation to an ordinary operation of the dishwasher 2. Furthermore, FIG. 1 shows a further wash arm assembly 10. The embodiments herein may be applied to the wash arm assembly 1 and/or the further wash arm assembly 10. For simplicity, it is in the following referred to the wash arm assembly 1 only.

Figure 2:
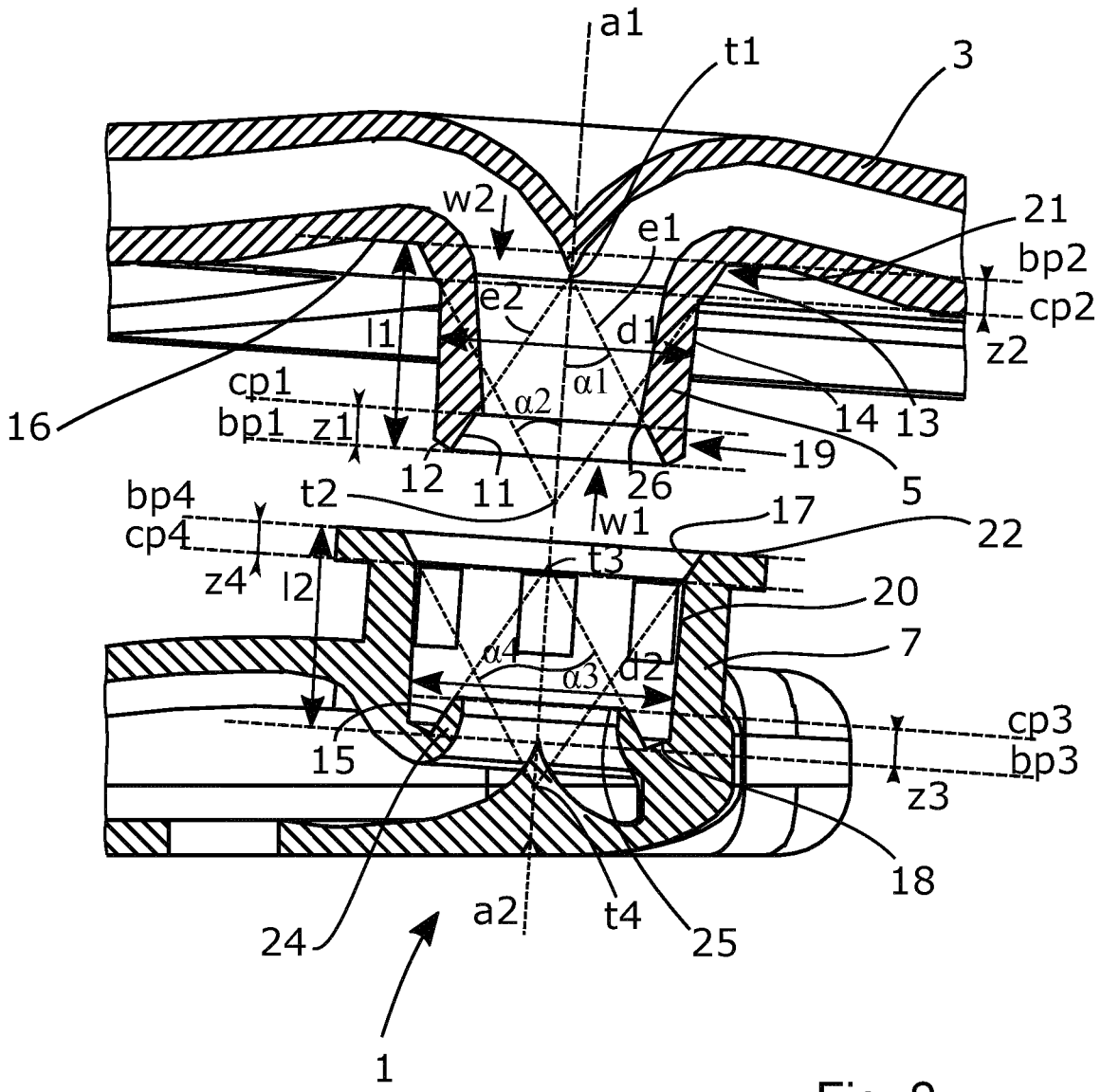
FIG. 2 is a plan view illustrating the wash arm assembly illustrated in FIG. 1, wherein the wash arm assembly is disassembled.

FIG. 2 illustrates a more detailed side-view of the wash arm assembly 1 shown in FIG. 1. The wash arm assembly 1 is arranged for assembling a wash arm 3 of a dishwasher. In other words the wash arm assembly 1 is arranged for mounting of the wash arm 3 within the dishwasher. In a further embodiment, the wash arm assembly 1 includes the wash arm 3 being rotatably mounted to the rotatable main spray arm 23.

The wash arm assembly 1 comprises the wash arm 3 and a tubular receiving portion 7, such as a tubular element, pipe piece or the like. Further, the wash arm 3 comprises a tubular connection portion 5, such as tubular element, pipe piece or the like, arranged to be inserted in the tubular receiving portion 7 to create a seal connection 9 (shown in FIG. 3) between the tubular connection portion 5 and the tubular receiving portion 7. The FIG. 2 illustrates a detailed side-view of the wash arm assembly 1 with focus on the tubular connection portion 5 and the tubular receiving portion 7. In some embodiments herein, the tubular connection portion 5 is arranged as an integrated part of the wash arm 3. The connection portion 5 may also be arranged as a separate member that may be connected to the wash arm 3. The seal 9 according to the embodiments herein may also be called for hydraulic ejector connection because of the form of channels for delivering the washing liquid to the wash arm 3. Hydraulic ejector connections are well known in the art and therefore not described in details herein.

The tubular connection portion 5 and the tubular receiving portion 7 are formed as tubes, i.e. shaped as generally circular or cylindrical pipes having a plurality of differently angled and overlapping surfaces as described herein. The tubular connection portion 5 has a first diameter d1 and a length 11 and the tubular receiving portion 7 has a second diameter d2 and a depth 12. The first diameter d1 indicates an outer diameter of the tubular connection portion 5. The second diameter d2 indicates an inner diameter of the tubular receiving portion 7. The first diameter d1 is less than the second diameter d2 to enable insertion of the tubular connection portion 5 into the tubular receiving portion 7. In some embodiments, the first diameter d1 and/or the second diameter d2 may vary along the axial length (e.g., the length along or parallel to the first direction w1 and the second direction w2) of the respective tubular receiving portion 7 and tubular connection portion 5. In such embodiments, the first diameter d1 may be less than the second diameter d2 at the respective axial positions, with the exception of the lip described below.

Clearance between the first diameter d1 and the second diameter d2 may be in a range of 1-3 mm. This clearance may allow the wash arm 3 to rotate sufficiently freely by lubricating the connection between the tubular receiving portion 7 and the tubular connection portion 5, while also preventing excessive leakage from the connection.

The tubular connection portion 5 and tubular receiving portion 7 may form a seal 9 therebetween that prevents excessive leakage from the connection between the wash arm 3 and the main spray arm 23 (or the other respectively connected components described herein). The seal 9 may be defined by a plurality of sealing surfaces 11, 12, 13, 14, 15, 16, 17, 18, 20, 22, at least some of which combine to define a tortuous flow path for the washing liquid flowing through the connection. Using the tortuous flow path of the seal 9, the washing liquid may be substantially prevented from leaking from between the wash arm 3 and the tubular receiving portion 7. In particular, the tortuous flow path of the seal 9 creates a back pressure that must be overcome for the washing liquid to leak between the tubular connection portion 5 and the tubular receiving portion 7. The pressure required to overcome the seal may be called the strength of the seal. In some embodiments, the back pressure required to overcome the seal 9 may be greater than the pressure of the fluid in the wash arm 3 or main wash arm 23. Said differently, the back pressure required to overcome the seal 9 may be greater than the liquid pressure within tubular connection portion 5 or tubular receiving portion 7 of the seal 9. In some embodiments, minor leakage may be allowed between the wash arm 3 and tubular receiving portion 7 to lubricate the connection therebetween and reduce friction during operation of the wash arm 3.

The tubular receiving portion 7 may include a lip 24 that overlaps a portion of the tubular connection portion 5. With continued reference to FIG. 2, the depicted lip 24 is positioned radially inward of the upstream end 19 of the tubular connection portion 5 to prevent the washing liquid traveling in the first direction (w1) from aligning with and directly entering the tortuous flow path between the tubular receiving portion 7 and the tubular connection portion 5. A leading edge 25 of the lip 24 may be oriented perpendicular to the first direction (w1) or at least partially in the first direction (w1) when viewed in a radially inward direction (e.g., the lip edge may be pointed away from the fluid flow direction when as shown in FIG. 2) so that washing liquid is not directly forced between the tubular receiving portion 7 and the tubular connection portion 5. With reference to FIG. 2, the depicted lip 24 includes the third sealing surface 15 on a radially-outward side thereof, opposite the washing liquid flow.

The tubular connection portion 5 comprises a first sealing surface 11 and a second sealing surface 13, and the tubular receiving portion 7 comprises a third sealing surface 15 and a fourth sealing surface 17. The length 11 of the tubular connection portion 5 and the depth 12 of the tubular receiving portion 7 are determined to achieve an alignment of the first sealing surface 11 with the third sealing surface 15 and the second sealing surface 13 with the fourth sealing surface 17 when the tubular connection portion 5 is inserted into the tubular receiving portion 7. Further, the length 11 of the tubular connection portion 5 is determined in order to place the first sealing surface 11 below a center of gravity (not shown) of the wash arm 3. For example, the first sealing surface 11 may be arranged 20 mm below the center of gravity of the wash arm 3.

According to some embodiments herein, the tubular receiving portion 7 is arranged at the main wash arm 23, sometimes also referred to as a central wash arm. In such embodiments, the tubular receiving portion 7 may be an integral part of the main wash arm 23. As illustrated in FIG. 1, the tubular receiving portion 7 may be arranged at a peripheral portion of the main wash arm 23 in relation to a main axis a1 around which the main wash arm 23 is rotatable. Then, the wash arm 3 may be connected to the main wash arm 23 at said peripheral portion of the main wash arm 23.

In some embodiments, the tubular receiving portion 7 is connectable to a conduit arranged to convey the washing liquid to an interior of the dishwasher. Thus, the tubular receiving portion 7 may be arranged at a tube (not shown) for supply the washing liquid to the dishwasher. In such an embodiment, the wash arm 3 is directly connected to the tube.

The tubular receiving portion 7 may be arranged as a separate member arranged to be fastened to the main wash arm 23 or to the tube. According to some embodiments herein, the tubular receiving portion 7 is arranged as a part of the main wash arm 23.

As illustrated in FIG. 2, the tubular connection portion 5 comprises the first sealing surface 11 and the second sealing surface 13, and the tubular receiving portion 7 comprises the third sealing surface 15 and the fourth sealing surface 17. Thereby, the tubular connection portion 5 is guided, or in other words led or positioned by the first, second, third and fourth sealing surfaces 11, 13, 15, 17 in a predetermined position in relation to the tubular receiving portion 7 when the tubular insertion portion 5 is inserted in the tubular receiving portion 7.

With continued reference to FIG. 2, the tubular connection portion 5 may further comprise a fifth sealing surface 12, a sixth sealing surface 14, and a seventh sealing surface 17. Each of the sealing surfaces 11, 12, 13, 14, 16 of the tubular connection portion 5 may be disposed sequentially adjacent to one or more other surfaces in sequence (e.g., connected edge to edge) from the interior of the connection (e.g., from the washing liquid flow path within the tubular connection portion 5) to the exterior of the connection (e.g., outside the spray arm assembly within the tub) as shown in FIG. 2 to create one side of the tortuous flow path. Similarly, the tubular receiving portion 7 may further comprise an eighth sealing surface 18, a ninth sealing surface 20, and a tenth sealing surface 22. Each of the sealing surfaces 15, 17, 18, 20, 22 of the tubular receiving portion 7 may be disposed sequentially adjacent to one another from the interior of the connection (e.g., from the washing liquid flow path within the tubular connection portion 5) to the exterior of the connection (e.g., outside the spray arm assembly within the tub) as shown in FIG. 2 to create the other side of the tortuous flow path.

The respective sealing surfaces of the tubular connection portion 5 and the tubular receiving portion 7 may be aligned with each other to define the tortuous flow path of the seal 9. With aligned is meant that the first sealing surface 11 and the third sealing surface 15; the fifth sealing surface 12 and the eighth sealing surface 18; the sixth sealing surface 14 and the ninth sealing surface; the second sealing surface 13 and fourth sealing surface 17; and the seventh sealing surface 16 and the tenth sealing surface 22, respectively, are substantially parallel to each other and may have a contact with each other or there may be a distance between the pairs of surfaces when the connection portion 5 is inserted in the receiving portion 7.

In the embodiment shown in FIG. 2, the tubular connection portion 5 and tubular receiving portion 7 are arranged such that the pairs of respective surfaces 11, 12, 13, 14, 15, 16, 17, 18, 20, 22 are arranged edge to edge with each pair of surfaces being angled relative to the surfaces on either side to define the tortuous flow path. The flow path between the tubular connection portion 5 and the tubular receiving portion 7 may be sufficiently convoluted and long that substantially all of the washing liquid may continue into the wash arm 3 and not flow out of the space between the connection portion 5 and the receiving portion 7. In such embodiments, a seal 9 is formed between the tubular connection portion 5 and the tubular receiving portion 7 using only the convolution and length of the tortuous flow path and without requiring the tubular connection portion 5 and the tubular receiving portion 7 to be rigidly or fixedly attached or have any additional sealing component (e.g., by a gasket, O-ring, threads, sealant, or the like). The seal 9 may allow minor leakage between the surfaces 11, 12, 13, 14, 15, 16, 17, 18, 20, 22 to lubricate the rotation of the wash arm 3, while substantially all of the washing liquid carries on into the wash arm 3.

When viewed in cross section (e.g., as shown in FIG. 2), the combination of pairs of sealing surfaces may define the seal 9 beginning at the leading edge 25 of the lip 24 of the tubular receiving portion 7 and the leading surface 26 of the tubular connection portion 5 and extending to the wash chamber, outside the wash arm assembly. The leading edge 25 and leading surface 26 may be disposed adjacent a central bore of the seal 9 and the fluid connection between the wash arm 3 and the main wash arm 23, the tubular connection portion 5, and the tubular receiving portion 7 through which the washing liquid flows and may have at least a portion of the leading edge 25 and leading surface 26 beginning or terminating at the bore. From the leading edge 25 and leading surface 26, the tortuous flow path of the seal 9 may extend at least partially in the second direction (w2) along the interface between the first sealing surface 11 and the third sealing surface 15; then along the interface between the fifth sealing surface 12 and the eighth sealing surface 18; then along the interface between the sixth sealing surface 14 and the ninth sealing surface 20; then along the interface between the second sealing surface 13 and the fourth sealing surface 17, and then along the interface between the seventh sealing surface 16 and the tenth sealing surface 22 to the exterior of the wash arm assembly. In the depicted embodiment, the angle of the flow path, when viewed in the vertical cross section of FIG. 2, changes at the junction of each pair of surfaces. In some embodiments, the junction between pairs of surfaces may be sharp, corresponding to a substantially immediate change in angle. Where the angle between surfaces changes, the junction between surfaces of differing angles (e.g., creating a turn in the flow path) may be called a convolution. In some other embodiments, the junction between pairs of surfaces may be at least partially rounded. In some embodiments, the seal may include at least one convolution. In some embodiments, the seal may include at least two convolutions. In some embodiments, the seal may include at least three convolutions. In some embodiments, the seal may include at least four convolutions. In some embodiments, the seal may include at least five convolutions. In some embodiments, the seal may include at least six convolutions.

In some embodiments, greater or fewer pairs of surfaces may be used to seal the wash arm 3 with the tubular receiving portion 7. For example, with reference to FIG. 2, openings may be formed in the ninth sealing surface 20 of the tubular receiving portion 7, which releases the seal 9 downstream of the openings (e.g., on the same side of the openings as the tenth sealing surface 22). In such embodiments, the seal 9 may be formed by the leading edge 25; the first and third sealing surfaces 11, 15; the fifth and eighth sealing surfaces 12, 18; and/or the portion of the sixth and ninth sealing surfaces 14, 20 upstream of the openings.

The sealing quality of the tortuous flow path is dependent, inter alia, upon the total magnitude of the angles of the convolutions (e.g., the sum of the absolute values of the change in angle between each adjacent section of the seal) and the length of the tortuous flow path between the tubular connection portion 5 and the tubular receiving portion 7. Thus, fewer total convolutions may be needed if their angles (e.g., the change in angle from one pair of surfaces to the adjacent surface) are large or the surfaces are long (e.g., the distance between convolutions is greater and thus the total length of the tortuous flow path is longer). Likewise, greater total convolutions may be needed if their angles are small or the surfaces are short. In some embodiments, the total magnitude of the angles of the convolutions should be at least 90 degrees. In some embodiments, the total magnitude of the angles of the convolutions should be at least 180 degrees. In some embodiments, the total magnitude of the angles of the convolutions should be greater than 90 degrees and less than 180 degrees. It is also noted that the initial angle of the leading edge 25 of the tubular receiving portion 7 and the leading surface of the tubular connection portion 5 may affect the total seal strength needed. For example, if the leading edge 25 is oriented away from the first direction (w1) or perpendicular to the first direction, the washing liquid may not directly flow into the tortuous flow path and the total seal needed is reduced.

With continued reference to FIG. 2, in some embodiments, the angles $\alpha 1$, $\alpha 2$, $\alpha 3$, $\alpha 4$ may each be approximately 30°. In some embodiments, the angles $\alpha 1$, $\alpha 2$, $\alpha 3$, $\alpha 4$ may each be exactly 30°. In some embodiments, the angles $\alpha 1$, $\alpha 2$, $\alpha 3$, $\alpha 4$ may each be from 25° to 35°. In some embodiments, the angles $\alpha 1$, $\alpha 2$, $\alpha 3$, $\alpha 4$ may each be from 22° to 45°. In embodiments where the distance 11 is long (e.g., the limit as 11 approaches infinity), the angles $\alpha 1$, $\alpha 2$, $\alpha 3$, $\alpha 4$ may each be approximately 45°. In embodiments where the distance 11 is as short as possible, the angles $\alpha 1$, $\alpha 2$, $\alpha 3$, $\alpha 4$ may each be approximately 22°.

In some embodiments, the seal 9 may define at least one surface oriented at least partially in the second direction (w2) (e.g., the first and third sealing surfaces 11, 15 which slope at least partially in the second direction when viewed relative to the axis (a1, a2)) and at least one surface oriented at least partially in the first direction (w1) (e.g., the fifth and eighth sealing surfaces 12, 18 which slope at least partially in the first direction when viewed relative to the axis (a1, a2)). Said differently, in some embodiments, the cone of which a given surface forms a part (e.g., cones defined by lines extending from the surface to the axis (a1, a2) revolved about the axis (a1, a2) to form a cone) may point in the second direction for at least one surface of the seal 9 and downwardly for at least one surface of the seal.

For example, in the embodiment of FIG. 2, the cone formed by the angle α1 between the first sealing surface 11 and the axis a1 is pointed upwardly. Conversely, in the embodiment of FIG. 2, the cone formed by the angle α2 between the second sealing surface 13 and the axis a1 is pointed downwardly. In the embodiment of FIG. 2, the cone defined by the the third sealing surface 15 is pointed upwardly; the cone defined by the fourth sealing surface 17 is pointed downwardly; the cone defined by the fifth sealing surface 12 is pointed downwardly; the cone defined by the sixth sealing surface 14 is pointed downwardly or the sixth sealing surface 14 may define a cylinder parallel to or concentric with the axis a1; the seventh sealing surface 16 defines a disc perpendicular to the axis a1; the cone defined by the eighth sealing surface 18 is pointed downwardly; the cone defined by the ninth sealing surface 20 is pointed downwardly or the ninth sealing surface 20 may define a cylinder parallel to or concentric with the axis a2; the cone defined by the tenth sealing surface 22 defines a disc perpendicular to the axis a2; and the leading edge 25 and leading surface 26 may define a disc perpendicular to the axes a1, a2 or may be pointed upwardly.

In some embodiments, with continued reference to FIG. 2, the flow path between the tubular connection portion 5 and the tubular receiving portion 7 may extend from the washing liquid flow, substantially perpendicular to the first direction w1, between the leading edge 25 and leading surface 26. The flow path may then turn towards the second direction w2 further and continue between the first sealing surface 11 and the third sealing surface 15. The flow path may next turn partly towards the first direction w1 and continue between the fifth sealing surface 12 and the eighth sealing surface 18. Then the flow path may turn further towards the first direction w1 and continue between the sixth sealing surface 14 and the ninth sealing surface 20. The flow path may then turn back partly away from the first direction w1 (e.g., with a smaller slope relative to the first direction) and toward a direction perpendicular to the first direction w1 to continue between the second sealing surface 13 and the fourth sealing surface 17. Then the flow path may turn further away from the first direction w1 and continue between the seventh sealing surface 16 and the tenth sealing surface 22. In some embodiments, the preceding sequence may terminate between the sixth sealing surface 14 and ninth sealing surface 20 through openings disposed in the tubular receiving portion 7.

According to the embodiments herein the tubular connection portion 5 is tapered in a first direction w1 along the first sealing surface 11 constituting a part of an internal surface of the tubular connection portion 5. The direction w1 is a direction the washing liquid is delivered to the wash arm 3 through the tubular connection portion 5 of the wash arm 3.

The tubular connection portion 5 is also tapered in a second direction w2, being opposite to the first direction w1, along the second sealing surface 13 constituting a part of an external surface the tubular connection portion 5. Internal and external relate to a common meaning of what is meant with interior and exterior of a tube for delivering a liquid. Consequently, interior means where the liquid flows in the tube.

In a similar way, the tubular receiving portion 7 is tapered in the first direction w1 along the third sealing surface 15 and is tapered in the second direction w2 along the fourth sealing surface 17. Both the third sealing surface 15 and the fourth sealing surface 17 constitute a part of an internal surface of the tubular receiving portion 7.

As illustrated in FIG. 2, the tubular connection portion 5 comprises an upstream edge 19 and a downstream edge 21 in relation to a stream of washing liquid in the first direction w1, wherein the first sealing surface 11 is arranged at the upstream edge 19 and the second sealing surface 13 is arranged at the downstream edge 21. In the depicted embodiment, the tubular receiving portion 5 surrounds the upstream edge 19 of the tubular connection portion 5 via the third sealing surface 15, the eighth sealing surface 18, and the ninth sealing surface 20.

The first, second, third and fourth sealing surfaces 11, 13, 15, and 17 are arranged so the first sealing surface 11 is aligned to the third sealing surface 15 and the second sealing surface 13 is aligned to the fourth sealing surface 17 when the tubular connection portion 5 is inserted in the tubular receiving portion 7. As discussed herein, aligned is meant that the first, and third sealing surfaces 11, 15 respectively the second and fourth sealing surfaces 13, 17 are substantially parallel to each other and may have a contact with each other or there may be a distance between the surface 11, 15 when the connection portion 5 is inserted in the receiving portion 7.

Before the washing liquid is delivered to the wash arm 3, the first, second, third and fourth sealing surfaces 11, 13, 15, and 17 may abut against, or have contact with or touch, each other as described above when the tubular connection portion 5 is inserted in the tubular receiving portion 7. When the washing liquid is supplied to the wash arm 3, lift forces are created in the wash arm 3. The lift forces may lift the wash arm 3 if the pressure is enough to overcome all forces, for example gravitational forces or forces from spray nozzles 30 of the wash arm 3, acting on the wash arm 3 in the second direction w2, opposite to the first direction w1 of delivering the washing liquid. When the wash arm 3 lifts the first sealing surface 11 and the third sealing surface 15 respectively the second sealing surface 13 and the fourth sealing surface 17 are separated from each other. Thus, allowing washing liquid to lubricate the connection 9 in FIG. 3.

In some embodiments, when fluid is flowing through the nozzles 30 of the wash arm 3 in generally the first direction w1, the fluid pressure exiting the nozzles 30 may create an opposite reaction force that presses downwardly on the wash arm 3 in the second direction w2. In some embodiments, the upward force (e.g., in the first direction w1) on the wash arm 3 caused by fluid pressure within the wash arm assembly (1, 10) may be less than the downward reaction force from the nozzles 30 (e.g., in the second direction w2) such that the wash arm 3 remains seated on the tubular receiving portion 7 during operation. In such embodiments, the guiding and sealing surfaces described herein may align the wash arm 3 and seal the connection between the tubular connection portion 5 and the tubular receiving portion 7 without requiring additional fasteners, brackets, or other attachment means. In addition, the downward pressure on the wash arm 3 in the second direction w2 caused by the reaction force from the nozzles 30 may increase proportionately with the pressure in the main wash arm 23 and the wash arm 3. In such embodiments, the seal strength increases as the fluid pressure in the connection between the tubular connection portion 5 and the tubular receiving portion 5 increases. This relationship between seal strength and fluid pressure may keep the wash arm 3 connection substantially sealed while also minimizing unnecessary wear caused by holding the tubular connection portion 5 and the tubular receiving portion 7 too tightly together. In such embodiments, the tubular connection portion 5 and tubular receiving portion 7 may each be made of a single, uniform material without O-rings, gaskets, or other friction reducing or liquid sealing structure disposed therebetween.

The washing liquid has a primary purpose of washing dishware accommodated in the dishwasher. The washing liquid delivered to the wash arm 3 also has a secondary purpose of driving the wash arm 3 during the rotational movement. The wash arm 3 comprises one or several driving nozzles (not shown) arranged at a periphery of the wash arm 3.

The first, second, third and fourth sealing surfaces 11, 13, 15, 17 are arranged to guide the tubular connection portion 5 and the tubular receiving portion 7 into alignment with each other upon rotation of the wash arm 3. During rotation of the wash arm 3 the first sealing surface 11 cooperates with the third sealing surface 15 and the second sealing surface cooperates with the fourth sealing surface 17 to guide the tubular connection portion 5 and the tubular receiving portion 7 into alignment with each other.

The tubular connection portion 5, and along with it also the wash arm 3, and the tubular receiving portion 7 are guided into alignment with each other upon rotation of the wash arm 3 thanks to the first, second, third and fourth sealing surfaces 11, 13, 15, 17 that are defined by envelope surfaces of cut-off cones as described below.

The first sealing surface 11 is defined by a first envelope surface of a first cut-off cone pointing in the first direction w1. The first cut-off cone is cut-off from a first main cone with a first virtual top t1, or a first virtual peak, that may be located on a rotational axis a1 of the wash arm 3 defined in the central bore of the seal 9. As shown in FIG. 2, the cut-off is done by a first cutting plane cp1 vertically orientated to the rotational axis a1 at a first distance z1 from a first base plane bp1 of the first main cone with the first virtual top t1. The first distance z1 may, for example be 3 mm.

A location of said first virtual top t1 relatively the first base plane bp1 determines a first inclination of said first main cone. The first inclination may be defined by a first angle $\alpha$1 between the rotational axis a1 and a first line e1 on the envelope surface of the first main with said first virtual top t1. The greater distance of the first virtual top t1 from the first base plane bp1 results in the greater first inclination of the first main cone i.e. the less the first angle $\alpha$1. The first angle $\alpha$1 may be in a range of 25-35 degrees.

The second sealing surface 13 is defined by a second envelope surface of a second cut-off cone pointing in the second direction w2. The second cut-off cone is cut-off from a second main cone with a second virtual top t2 that also may be located on the rotational axis a1. As shown in FIG. 2, the cut-off is done by a second cutting plane cp2 vertically orientated in relation to the rotational axis a1 of the wash arm 3 at a second distance z2 from a second base plane bp2 of the second main cone with the second virtual top t2. The second distance z2 may, for example be 3 mm.

Similarly to the first virtual top t1, a location of said second virtual top t2 relatively the second base plane bp2 defines a second inclination of said second main cone with the second virtual top t2. The second inclination may be defined by a second angle $\alpha$2 between the rotational axis a1 and a second line e2 on the envelope surface of the second main cone with said second virtual top t2. The greater distance of the second virtual top t2 from the second base plane bp2 results in the greater second inclination of the second main cone i.e. the less the second angle $\alpha$2. The second angle $\alpha$2 may be in a range of 30-45 degrees.

Said third and fourth sealing surfaces 15, 17 of the tubular receiving portion 7 are arranged in similar way to the first and second sealing surfaces 11, 13 of the tubular connection portion 5 described above. However, the third and fourth sealing surfaces 15, 17 are arranged in relation to a second axis a2 through a central bore of the seal 9 and tubular receiving portion 7.

The third sealing surface 15 is defined by a third envelope surface of a third cut-off cone pointing in the first direction w1. The third cut-off cone is cut-off from a third main cone with a third virtual top t3 that may be located on the second axis a2. As shown in FIG. 2, the cut-off is done by a third cutting plane cp3 vertically orientated to the second axis a2 of the tubular receiving portion 7 at a third distance z3 from a third base plane bp3 of the third main cone with the third virtual top t3. The third distance z3 may be equal or greater than the first distance z1. The third main cone with the third virtual top t3 has an inclination defined by a third angle $\alpha$3. According to some embodiments herein the third angle $\alpha$3 is substantially equal said first angle $\alpha$1.

Further, the fourth sealing surface 17 is defined by a fourth envelope surface of a fourth cut-off cone pointing in the second direction w2. The fourth cut-off cone is cut-off from a fourth main cone with a fourth virtual top t4 that may be located on the axis a2. As shown in FIG. 2, the cut-off is done by a fourth cutting plane cp4 vertically orientated to the axis a2 of the tubular receiving portion 7 at a fourth distance z4 from a fourth base plane bp4 of the fourth main cone with the fourth virtual top t4. The fourth distance z4 may be equal or less than the second distance z2. The fourth main cone with the fourth virtual top t4 has an inclination defined by a fourth angle $\alpha$4. According to some embodiments herein the fourth angle $\alpha$4 is substantially equal said second angle $\alpha$2.

Consequently, when a disturbance of the wash arm 3 occurs the tubular insertion 5 portion is guided back, e.g. brought back, to a position where the first, second, third and fourth sealing surfaces 11, 13, 15 and 17 align with each other upon rotation of the wash arm 3, thanks to that the tubular connection portion 5 and the tubular receiving portion 7 are tapered along the first, second, third and fourth sealing surfaces 11, 13, 15 and 17 as described above.

As an effect, the improved rotational movement of the wash arm is achieved without overly constraining the rotation of the wash arm and thereby an improved wash arm assembly is obtained.

Figure 3:
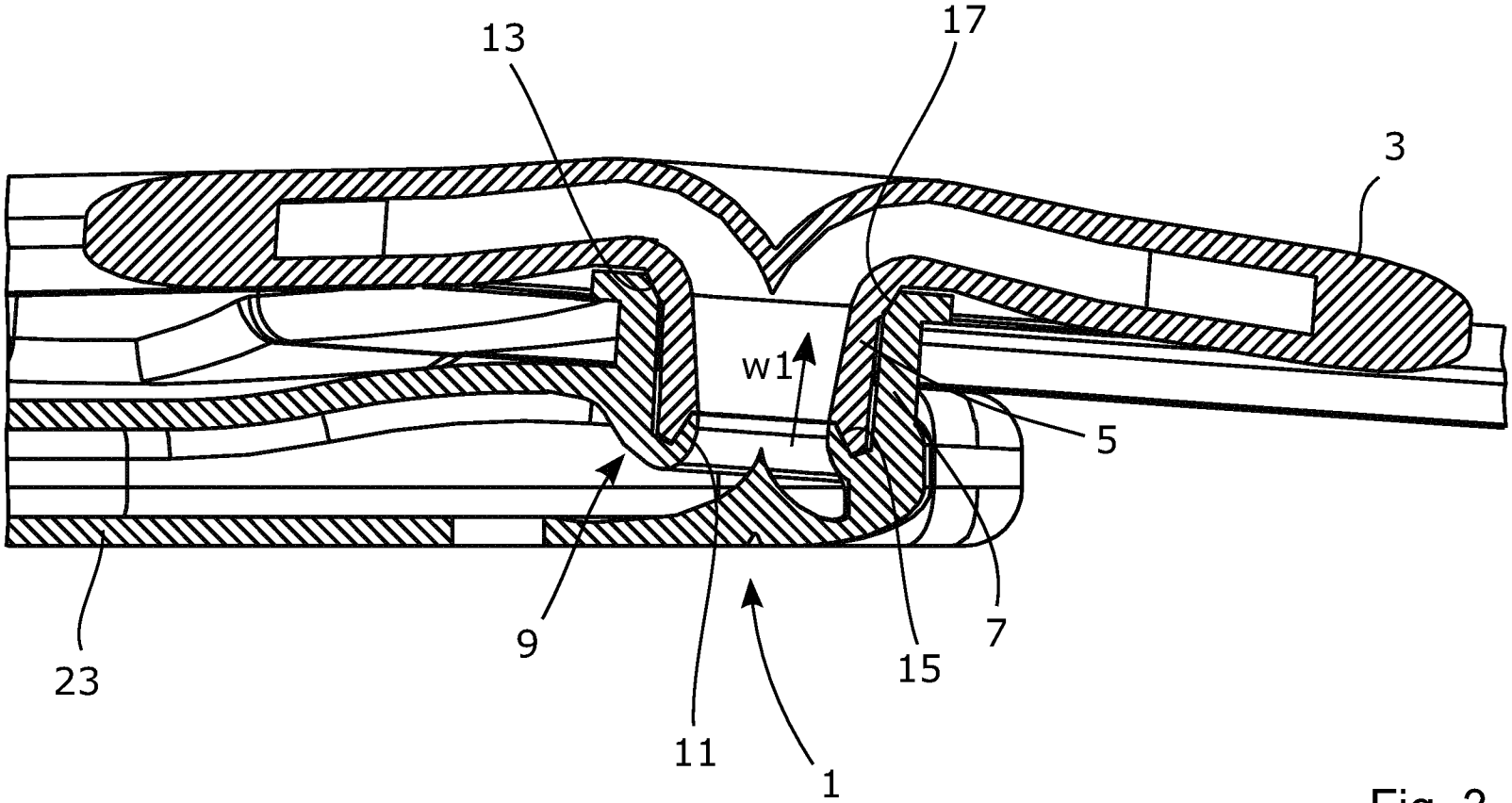
FIG. 3 is another plan view illustrating the wash arm assembly illustrated in FIG. 1, wherein the wash arm assembly is assembled.

FIG. 3 shows the wash arm assembly 1 illustrated in FIG. 1 and FIG. 2. In FIG. 3, a larger portion of the wash arm 3 and a larger portion of the main wash arm 23 are visible compared to FIG. 2. The tubular connection portion 5 is inserted into the tubular receiving portion 7 to create the seal connection 9 described above. As described above, the tubular connection portion 5 comprises the first sealing surface 11 and the second sealing surface 13, and the tubular receiving portion 7 comprises the third sealing surface 15 and the fourth sealing surface 17. According to FIG. 3 the first sealing surface 11 is aligned to the third sealing surface 15 and the second sealing surface 13 is aligned to the fourth sealing surface 17 i.e. the first, second, third and fourth sealing surfaces 11, 13, 15 and 17 are parallely orientated and in contact with each other when tubular connection portion 5 is inserted in the tubular receiving portion 7. The first, and third sealing surfaces 11, 15 as well as the second and fourth sealing surfaces 13, 17 are in contact with each other before pressure of a washing liquid, supplied to the wash arm 3, causes the wash arm 3 to be displaced in a direction w1. Accordingly, FIG. 3 illustrates the wash arm assembly 1 in before the wash arm 3 has lifted from the tubular receiving portion 7.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. While some drawings and description may omit features described elsewhere for simplicity of explanation, it is understood that these features may nonetheless be present in any of the embodiments in any combination or configuration, as detailed above. Although specific terms are employed herein, they are used in a generic and descriptive sense only and not for purposes of limitation.

The invention claimed is:

1. A wash arm assembly for a dishwasher, the wash arm assembly comprising:

a wash arm comprising a tubular connection portion and at least one nozzle; and a tubular receiving portion for receiving the tubular connection portion;

wherein the tubular connection portion is arranged to be inserted in the tubular receiving portion to create a seal between the tubular connection portion and the tubular receiving portion, wherein the seal allows the wash arm to rotate, and wherein the tubular receiving portion and the tubular connection portion are arranged to allow a washing liquid of the dishwasher to flow to the wash arm, wherein the tubular receiving portion defines a lip configured to overlap a portion of the tubular connection portion, at least a portion of the lip being disposed radially inward of the portion of the tubular connection portion such that the lip directs the flow of the washing liquid away from the seal between the tubular connection portion and the tubular receiving portion, wherein the tubular connection portion defines a first sealing surface and a second sealing surface, wherein the lip defines a third sealing surface, and wherein the tubular receiving portion defines a fourth sealing surface, and wherein the first sealing surface is aligned to the third sealing surface and the second sealing surface is aligned to the fourth sealing surface, and wherein the first sealing surface, the second sealing surface, the third sealing surface, and the fourth sealing surface define the seal.

2. The wash arm assembly according to claim 1, wherein the tubular receiving portion at least partially surrounds an upstream end of the tubular connection portion, and wherein the lip is disposed radially inward of the upstream end of the tubular connection portion.

3. The wash arm assembly according to claim 1, wherein the first sealing surface is adjacent to the second sealing surface, and wherein the third sealing surface is adjacent to the fourth sealing surface.

4. The wash arm assembly according to claim 1, wherein the tubular connection portion further comprises a fifth sealing surface and a sixth sealing surface, wherein the fifth sealing surface is aligned to the sixth sealing surface, and wherein the seal is defined by the first sealing surface, the second sealing surface, the third sealing surface, the fourth sealing surface, the fifth sealing surface, and the sixth sealing surface.

5. The wash arm assembly according to claim 4, wherein the respective pairs of the first sealing surface and the third sealing surface, the second sealing surface and the fourth sealing surface, and the fifth sealing surface and the sixth sealing surface are arranged sequentially to define the seal, wherein the first sealing surface and the third sealing surface are oriented at a different angle than the second sealing surface and the fourth sealing surface, and wherein the second sealing surface and the fourth sealing surface are oriented at a different angle than the fifth sealing surface and the sixth sealing surface.

6. The wash arm assembly according to claim 1, wherein the first sealing surface, the second sealing surface, the third sealing surface, and the fourth sealing surface have relative surface angles that are shaped as cut-off cones that direct the flow of the washing liquid.

7. The wash arm assembly according to claim 1, wherein the tubular connection portion and the tubular receiving portion are each made of a single material.

8. The wash arm assembly according to claim 7, wherein the tubular connection portion and the tubular receiving portion are configured to directly contact each other, and the seal does not include any structure between the tubular connection portion and the tubular receiving portion.

9. The wash arm assembly according to claim 1, wherein the lip of the tubular receiving portion defines a leading edge terminating at a central bore of the tubular connection portion and the tubular receiving portion.

10. The wash arm assembly according to claim 1, wherein at least one nozzle of the wash arm is oriented such that the strength of the seal increases as the pressure of the fluid exiting the nozzle increases.

11. The wash arm assembly according to claim 1, wherein the back pressure required to overcome the seal is greater than the liquid pressure within tubular connection portion or tubular receiving portion of the seal.

12. The wash arm assembly according to claim 1 further comprising a main wash arm, wherein the wash arm is a satellite arm rotatably mounted to the main wash arm at the seal, and wherein the main wash arm comprises the tubular receiving portion.

13. The wash arm assembly according to claim 1, wherein the tubular connection portion and tubular receiving portion are configured to allow a small amount of washing liquid therebetween to lubricate the seal.

14. The wash arm assembly according to claim 1, wherein said tubular receiving portion is connectable to a conduit arranged to convey the washing liquid to an interior of the dishwasher.

15. A dishwasher comprising the wash arm assembly according to claim 1.

* * * * *